US007345638B1

(12) United States Patent
Tan et al.

(10) Patent No.: US 7,345,638 B1
(45) Date of Patent: Mar. 18, 2008

(54) COMMUNICATIONS ASSEMBLY AND ANTENNA RADIATOR ASSEMBLY

(75) Inventors: Yu Chee Tan, Singapore (SG); Chao Feng, Singapore (SG); Swee (Gary) Hui Quek, Singapore (SG); Yew (Roger) Siow Tay, Singapore (SG)

(73) Assignee: Motorola Inc, Schaumburg, IL (US)

( * ) Notice: Subject to any disclaimer, the term of this patent is extended or adjusted under 35 U.S.C. 154(b) by 0 days.

(21) Appl. No.: 11/611,975

(22) Filed: Dec. 18, 2006

(51) Int. Cl.
*H01Q 1/24* (2006.01)

(52) U.S. Cl. ..... 343/702; 343/700 MS

(58) Field of Classification Search ..... 343/700 MS, 343/702, 846, 848
See application file for complete search history.

(56) References Cited

U.S. PATENT DOCUMENTS 6,614,398 B2 * 9/2003 Kushihi et al. ..... 343/700 MS
6,876,329 B2 * 4/2005 Milosavljevic ..... 343/700 MS
6,950,072 B2 * 9/2005 Miyata et al. ..... 343/702
7,015,864 B2 * 3/2006 Lin et al. ..... 343/702
7,136,020 B2 * 11/2006 Yamaki ..... 343/702
7,265,724 B1 * 9/2007 Tan et al. ..... 343/702

* cited by examiner

*Primary Examiner*—Tan Ho
(74) *Attorney, Agent, or Firm*—Steven Cosgrove

(57) ABSTRACT

An antenna radiator assembly (201) and radio communications assembly (200) comprising a circuit board (210) supporting electrical conductors, at least one of the electrical conductors being coupled to a feed point (130). There is a ground plane (140) with a first planar element (141) and a second planar element (142), the first planar (141) element being supported by the circuit board (210) and having a first planar element plane (240) parallel to a surface (250) of the circuit board (210), and the second planar element (142) having a second planar element plane (245) lateral to the first planar element plane (240). A ground connector is coupled to the ground plane (140) and the antenna radiator element (107) is coupled to both the ground connector and the feed point. The antenna radiator element (107) is spaced from the ground plane the antenna radiator element (107) has an antenna radiator element plane (295) is lateral to the first planar element plane (240).

19 Claims, 3 Drawing Sheets

200

COMMUNICATIONS ASSEMBLY AND ANTENNA RADIATOR ASSEMBLY

FIELD OF THE INVENTION

This invention relates to an antenna radiator assembly and radio communications assembly including an antenna assembly. The invention is particularly useful for, but not necessarily limited to, multi-band wireless communication devices with internal antennas.

BACKGROUND ART OF THE INVENTION

Wireless communication devices often require multi-band antennas for transmitting and receiving radio communication signals often called Radio Frequency (RF) signals. For example, network operators provide services on a GSM system in a 900 MHz frequency band typically used in Asia also use a DCS system in a 1800 MHz frequency band typically used in Europe. Accordingly, GSM wireless communication devices, such as cellular radio telephones, should have dual band antennas to be able to effectively communicate at least at both of these frequencies. Also, in certain countries service providers operate on 850 MHz or 1900 MHz frequency bands. Accordingly, GSM wireless communication devices, such as cellular radio telephones, should have multi band antennas to be able to effectively communicate on more than one of these frequency bands.

Current consumer requirements are for compact wireless communication devices that typically have an internal antenna radiator structure instead of an antenna stub that is visible to the user. There has also been a recent trend towards thin form factor cellular telephones. These thin form factor cellular telephones require a miniaturized antenna radiator structure comprising an antenna radiator structure coupled to a ground plane, the ground planes being typically formed on or in a circuit board of the telephone. Further, these internal antenna radiator structures (patch antennas), such as a Planar Inverted F Antenna (PIFA) or Planar Inverted L Antenna (PILA), that use a radiator element in the form of a microstrip internal patch antenna, are considered advantageous in several ways because of their compact lightweight structure, which is relatively easy to fabricate and produce with precise printed circuit techniques capable of integration on printed circuit boards.

Internal antenna radiator structures are typically installed inside a cellular phone where congested conductive and "lossy" components are placed nearby. The internal antenna radiator structures must therefore preferably be able to cover multiple frequency bands to, for instance, accommodate the 850 MHz, 900 MHz, 1800 MHz, 1900 MHz bands whilst not being the deciding factor that limits the thin form factor.

BRIEF DESCRIPTION OF THE DRAWINGS

In order that the invention may be readily understood and put into practical effect, reference now will be made to exemplary embodiments as illustrated with reference to the accompanying figures, wherein like reference numbers refer to identical or functionally similar elements throughout the separate views. The figures together with a detailed description below, are incorporated in and form part of the specification, and serve to further illustrate the embodiments and explain various principles and advantages, in accordance with the present invention, where.

Figure 1:
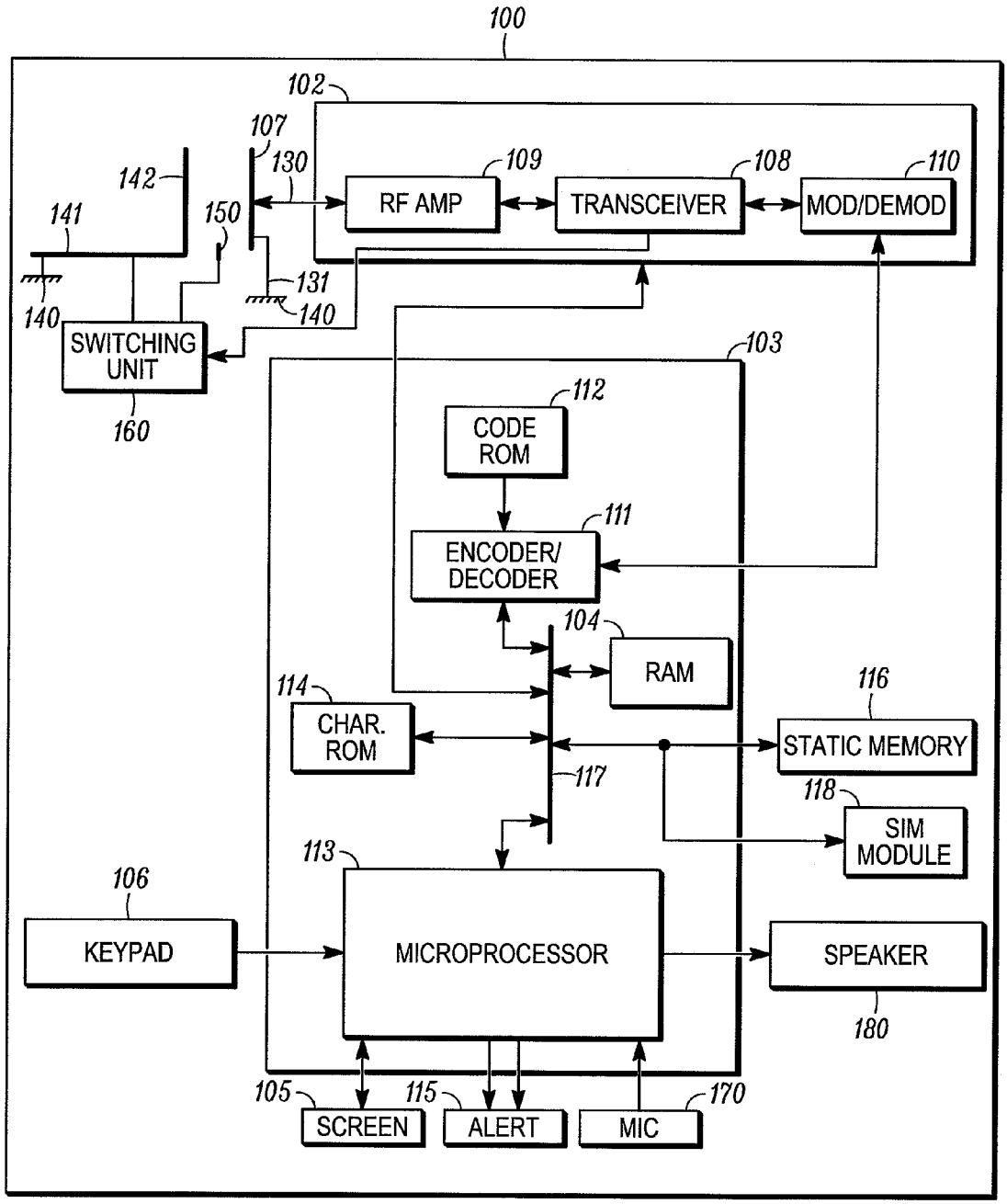
FIG. 1 is a schematic block diagram of a radio communications device in accordance with the present invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations apparatus components related to radio communications assemblies and antenna radiator assemblies. Accordingly, the assembly components have been represented where appropriate by conventional symbols in the drawings, showing only those specific details that are pertinent to understanding the embodiments of the present invention, so as not to obscure the disclosure with details that will be readily apparent to those of ordinary skill in the art having the benefit of the description herein.

In this document, relational terms such as left and right, first and second, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a radio communications assembly and antenna radiator assembly that comprises a list of elements does not include only those elements but may include other elements not expressly listed or inherent to such radio communications assemblies and antenna radiator assemblies. An element preceded by "comprises a . . . " does not, without more constraints, preclude the existence of additional identical elements in the radio communications assembly and antenna radiator assembly.

According to one aspect of the present invention there is provided an antenna radiator assembly comprising a circuit board supporting electrical conductors, at least one of the electrical conductors being coupled to a feed point. There is a ground plane with at least a first planar element and a second planar element, the first planar element being supported by the circuit board and having a first planar element plane parallel to a surface of the circuit board, and the second planar element having a second planar element plane lateral to the first planar element plane. A ground connector is coupled to the ground plane and at least one antenna radiator element is coupled to both the ground connector and the feed point. The least one antenna radiator element is spaced from the ground plane, wherein a surface area of the antenna radiator element having an antenna radiator element plane is lateral to the first planar element plane.

According to another aspect of the present invention there is provided a radio communications assembly comprising a housing within which is housed a circuit board supporting electrical conductors, at least one of the electrical conductors being coupled to a feed point. There is a ground plane, housed in the housing, the ground plane having at least a first planar element and a second planar element, the first planar element being supported by the circuit board and having a first planar element plane parallel to a surface of the circuit board, and the second planar element having a second planar element plane lateral to the first planar element plane. A ground connector is coupled to the ground plane and at least one antenna radiator element is housed in the housing. The antenna radiator element is coupled to both the ground connector and the feed point. The at least one antenna radiator element is spaced from the ground plane, wherein a surface area of the antenna radiator element having an antenna radiator element plane is lateral to the first planar element plane.

With reference to FIG. 1, there is illustrated a radio communications device in the form of a radio telephone 100 comprising radio frequency communications circuitry 102 coupled to be in communication with a processor 103. An input interface in the form of a screen 105 and a keypad 106 are also coupled to be in communication with the processor 103. As will be apparent to a person skilled in the art the screen 105 can be a touch screen thereby eliminating the need for the keypad 106.

The processor 103 includes an encoder/decoder 111 with an associated Code Read Only Memory (ROM) 112 storing data for encoding and decoding voice or other signals that may be transmitted or received by the radio telephone 100. The processor 103 also includes a micro-processor 113 coupled, by a common control, data and address bus 117, to the radio frequency communications circuitry 102, encoder/decoder 111, a character Read Only Memory (ROM) 114, a Random Access Memory (RAM) 104, static programmable memory 116 and a Subscriber Identity Module (SIM) interface 118 for operatively coupling with a removable SIM card. The static programmable memory 116 and a SIM card when operatively coupled to the SIM interface 118 each can store, amongst other things, selected incoming text messages and a telephone book database.

The micro-processor 113 has ports for coupling to the keypad 106, the screen 105, a speaker 180, a microphone 170 and an alert module 115 that typically contains a speaker, vibrator motor and associated drivers. The character Read only memory 114 stores code for decoding or encoding text messages that may be received by the radio frequency communication circuitry 102, input at the keypad 106. In this embodiment the character Read Only Memory 114 also stores operating code (OC) for micro-processor 113. As will be apparent to a person skilled in the art the radio telephone 100 also has and other components that are not illustrated.

The radio frequency communications circuitry 102 is has a transceiver 108 coupled to both a radio frequency amplifier 109 and a combined modulator/demodulator 110. There is also illustrated a radio frequency radiator element 107 that is directly coupled to the radio frequency amplifier 109 by a feed point 130. Thus, the feed point 130 provides for electrically coupling a radio frequency antenna radiator element 107 to the radio frequency communications circuitry 102. A ground connector 131 provides for inductively coupling the radio frequency antenna radiator element 107 to a ground plane 140.

The ground plane 140 includes a first planar element 141 and a second planar element 142. There is also a switching unit 160 coupled to, and controllable by, the transceiver 108. The switching unit 160 has switching terminals for selectively electrically coupling the parasitic tuning resonator 150 to the ground plane 140.

Figure 2:
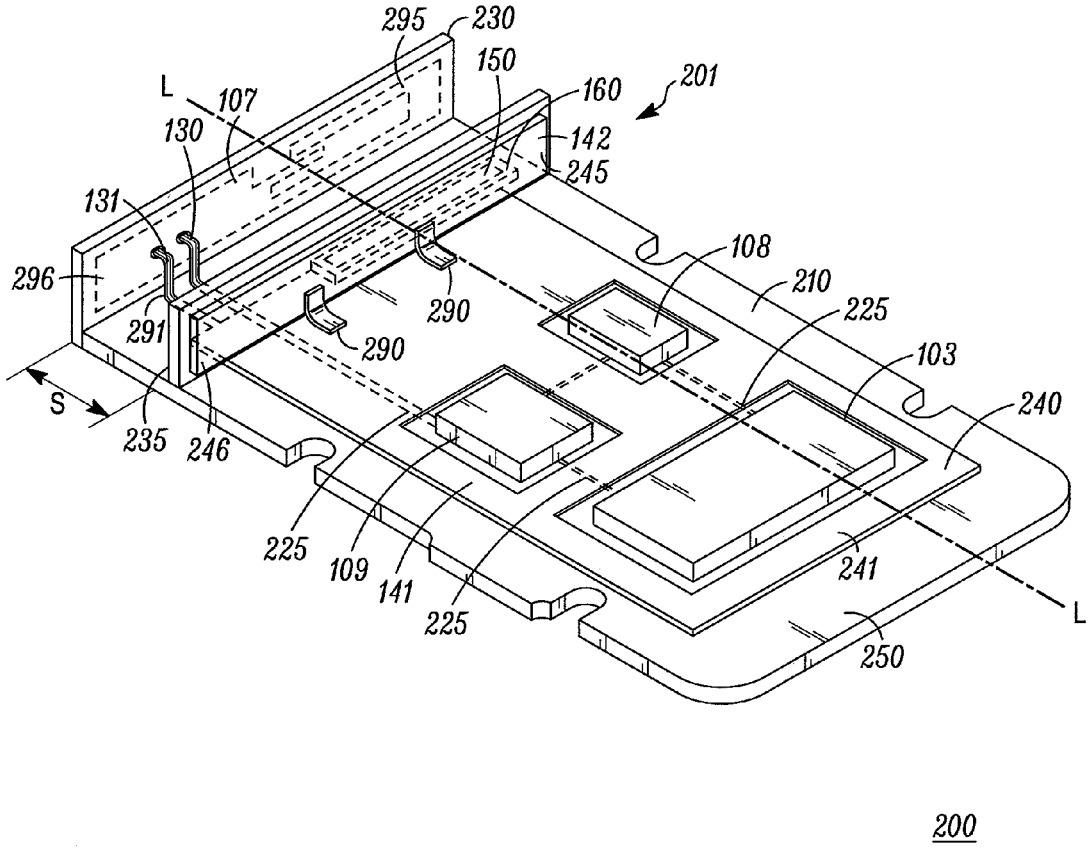
FIG. 2 is perspective view of a radio communications assembly including an antenna radiator assembly of a first embodiment in accordance with the invention.
Figure 3:
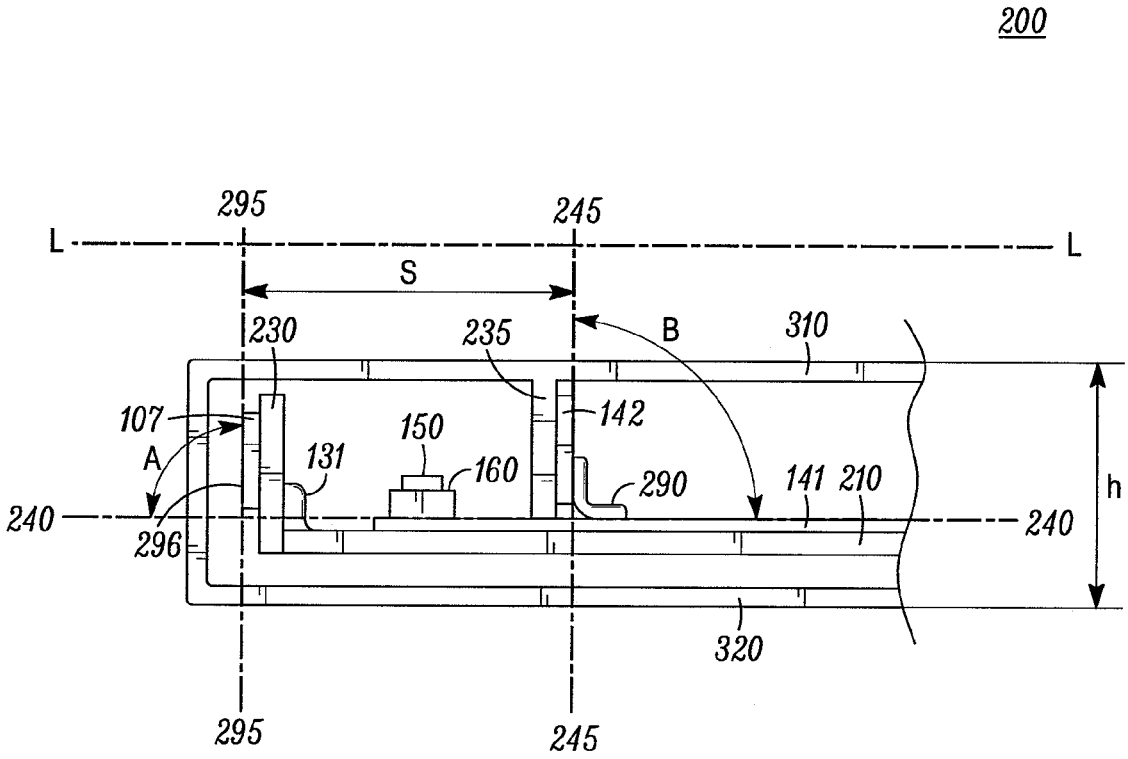
FIG. 3 is a plan view of part of part of a radio communications assembly that includes the antenna radiator assembly of FIG. 2.

Referring to FIGS. 2 and 3 there is illustrated one preferred embodiment of a radio communications assembly 200 including an antenna radiator assembly 201 forming part of the radio telephone 100. The radio communications assembly 200 comprises a circuit board 210 supporting electrical conductors 225 that are typically sandwiched inside the layers of the circuit board 210. The circuit board 210 provides a base for supporting the radio frequency amplifier 109, the transceiver 108, the processor 103 and the switching unit 160. There is a conductive plate or sheet supported by (mounted to or formed on) the circuit board 210, this conductive plate provides the first planar element 141 of the ground plane 140.

The first planar element 141 has a surface 241 with a first planar element plane 240 that is parallel to a surface 250 of the circuit board 210. The radio communications assembly 200 also includes the second planar element 142 that forms part of the ground plane 140, the second planar element 142 being mounted on a support 235 has a surface 246 with a second planar element plane 245 that is lateral to the first planar element plane 240. As shown, the second planar element 142 is electrically coupled to the first planar element 141 by conductive resilient legs 290. There are also other typical components/modules (not shown for clarity) and other conductive plates may be provided and combined forming the ground plane 140 that are mounted to or electrically coupled the circuit board 210.

The radio frequency antenna radiator element 107 is mounted to a dielectric mount 230 (typically formed from a thermoplastics material) that spaces the radio frequency antenna radiator element 107 from the ground plane 140. The radio frequency antenna radiator element 107 is a patch antenna and comprises a flat sheet having a surface area 296 in an antenna radiator element plane 295 that is lateral to the first planar element plane 240.

The antenna radiator element plane 295 is parallel to the second planar element plane 245 and both the antenna radiator element plane 295 and the second planar element plane 245 are orthogonal to (at right angles to) the first planar element plane 240. More specifically, the antenna radiator element plane 295 is at an angle A to the first planar element plane 240 and the second planar element plane 245 is at an angle B to the first planar element plane 240, where angle A is the same as angle B. Furthermore, both the antenna radiator element plane 295 and the second planar element plane 245 are orthogonal to a longitudinal axis L of the first planar element plane 240. The radio frequency antenna radiator element is also spaced along the longitudinal axis L from the second planar element 142 as illustrated by arrowed line S.

The antenna radiator assembly 201 also has the parasitic tuning resonator 150 mounted on the switching unit 160. The switching unit 160 is mounted in the space indicated by arrowed line S between the second planar element 142 and the radio frequency antenna radiator element 107, and in use the switching unit provides for selectively electrically coupling the parasitic tuning resonator 150 to the ground plane 140.

The radio frequency antenna radiator element 107 is coupled to the transceiver 108 unit through: a) the feed point 130, that contacts the radio frequency antenna radiator element 107 through an aperture in the dielectric mount 230; b) the radio frequency amplifier 109; and c) some of the electrical conductors or runners 225 coupled to the feed point 130 (most runners on circuit board 210 are not shown). Also, the ground connector 131 is coupled to the ground plane 140 by a runner 291 attached to the first planar element 141. The ground connector 131 is coupled to (contacts) the radio frequency antenna radiator element 107 through aperture in the dielectric mount 230.

The radio communications assembly 200 also includes a housing formed from an upper housing 310 and a lower housing 320 within which is housed the circuit board 210, the radio frequency antenna radiator element 107, the ground plane 140 plus other components mentioned above forming the antenna radiator assembly 201. Also, as shown the upper housing 310 includes the support 235. It will be apparent that the support 235 may be part of a conductive chassis on or in the upper housing 235 and thus the support 235 and second planar element 142 may be one and the same component. Similarly, the dielectric mount 230 may be part of the upper or lower housing 310,320. It will also be appreciated that the angles A and B may not necessarily be at right angles to the first planar element plane 240.

Advantageously, the present invention provides for compact, economic multi band internal antenna radiator assembly 201 and a radio communications assembly 200 capable of operating at multiple specified bands. In this regard, the spacing spaced along the longitudinal axis L between the ground plane 140 and the radio frequency antenna radiator element 107, as illustrated by arrowed line S, can result in a thin a form factor in which a height, illustrated by arrowed line h, is not necessarily dependent on the spacing of the antenna radiator assembly 201. In use, the present invention can operate at the 1900 MHz and 900 MHz bands and when the switching unit 160 electrically couples the parasitic tuning resonator 150 loading occurs and the frequency bands are modified (switched) to 1800 MHz and 850 MHz respectively.

The detailed description provides preferred exemplary embodiments only, and is not intended to limit the scope, applicability, or configuration of the invention. Rather, the detailed description of the preferred exemplary embodiments provide those skilled in the art with an enabling description only. It should be understood that various changes may be made in the function and arrangement of elements without departing from the spirit and scope of the invention as set forth in the appended claims.

We claim:

1. An antenna radiator assembly comprising:

a circuit board supporting electrical conductors, at least one of the electrical conductors being coupled to a feed point;

ground plane with at least a first planar element and a second planar element, the first planar element being supported by the circuit board and having a first planar element plane parallel to a surface of the circuit board, and the second planar element having a second planar element plane lateral to the first planar element plane;

a ground connector coupled to the ground plane; and at least one antenna radiator element coupled to both the ground connector and the feed point, and the least one antenna radiator element being spaced from the ground plane, wherein a surface area of the antenna radiator element having an antenna radiator element plane is lateral to the first planar element plane.

2. An antenna radiator assembly as claimed in claim 1, wherein the antenna radiator element is a patch antenna.

3. An antenna radiator assembly as claimed in claim 1, wherein the antenna radiator element comprises a flat sheet.

4. An antenna radiator assembly as claimed in claim 1, wherein the antenna radiator element plane is parallel to the second planar element plane.

5. An antenna radiator assembly as claimed in claim 4, wherein the antenna radiator element plane is orthogonal to the first planar element plane.

6. An antenna radiator assembly as claimed in claim 4, wherein the antenna radiator element plane is orthogonal to a longitudinal axis of the first planar element plane and wherein the second planar element plane is orthogonal to the longitudinal axis of the first planar element plane.

7. The antenna radiator assembly as claimed in claim 6, wherein the antenna radiator element is spaced along the longitudinal axis from the second planar element.

8. An antenna radiator assembly as claimed in claim 7 the antenna radiator assembly further comprising;

a parasitic tuning resonator; and a switching unit selectively electrically coupling the parasitic tuning resonator to the ground plane.

9. The antenna radiator assembly as claimed in claim 8, wherein the parasitic tuning resonator is mounted on the switching unit.

10. The antenna radiator assembly as claimed in claim 7, wherein the parasitic tuning resonator is mounted on the switching unit.

11. An antenna radiator assembly as claimed in claim 1, the antenna radiator assembly further comprising;

a parasitic tuning resonator; and a switching unit selectively electrically coupling the parasitic tuning resonator to the ground plane.

12. A radio communications assembly comprising:

a housing within which is housed a circuit board supporting electrical conductors, at least one of the electrical conductors being coupled to a feed point;

ground plane, housed in the housing, the ground having at least a first planar element and a second planar element, the first planar element being supported by the circuit board and having a first planar element plane parallel to a surface of the circuit board, and the second planar element having a second planar element plane lateral to the first planar element plane;

a ground connector coupled to the ground plane; and at least one antenna radiator element housed in the housing, the antenna radiator element being coupled to both the ground connector and the feed point, and the least one antenna radiator element being spaced from the ground plane, wherein a surface area of the antenna radiator element having an antenna radiator element plane is lateral to the first planar element plane.

13. A radio communications assembly as claimed in claim 12, wherein the radiator element plane is orthogonal to parallel to the first planar element plane.

14. A radio communications assembly as claimed in claim 13 wherein the antenna radiator element plane is orthogonal to the first planar element plane.

15. A radio communications assembly as claimed in claim 14 wherein the antenna radiator element plane is orthogonal to a longitudinal axis of the first planar element plane and wherein the second planar element plane is orthogonal to the longitudinal axis of the first planar element plane.

16. A radio communications assembly as claimed in claim 15, wherein the antenna radiator element is spaced along the longitudinal axis from the second planar element.

17. A radio communications assembly as claimed in claim 16, the antenna radiator assembly further comprising;

a parasitic tuning resonator; and a switching unit selectively electrically coupling the parasitic tuning resonator to the ground plane.

18. A radio communications assembly as claimed in claim 12, wherein the antenna radiator element comprises a flat sheet.

19. A radio communications assembly as claimed in claim 12, the antenna radiator assembly further comprising;

a parasitic tuning resonator; and a switching unit selectively electrically coupling the parasitic tuning resonator to the ground plane.

* * * * *